US005684394A

United States Patent [19]

Marshall

[11] Patent Number: 5,684,394

[45] Date of Patent: Nov. 4, 1997

[54] BETA HELPER FOR VOLTAGE AND CURRENT REFERENCE CIRCUITS

[75] Inventor: Andrew Marshall, Dallas, Tex.

[73] Assignee: Texas Instruments Incorporated, Dallas, Tex.

[21] Appl. No.: 639,941

[22] Filed: Apr. 18, 1996

Related U.S. Application Data

[63] Continuation of Ser. No. 267,326, Jun. 28, 1994, abandoned.

[51] Int. Cl.[6] ..... G05F 3/16

[52] U.S. Cl. ..... 323/315; 323/314

[58] Field of Search ..... 323/312, 313, 323/314, 315, 316, 317, 907

[56] References Cited

U.S. PATENT DOCUMENTS

| | | | |
|---|---|---|---|
| 3,721,893 | 3/1973 | Davis | 323/317 |
| 4,008,441 | 2/1977 | Schade, Jr. | 323/315 |
| 4,525,682 | 6/1985 | Lai et al. | 323/315 |
| 4,859,929 | 8/1989 | Raguet | 323/316 |
| 4,939,442 | 7/1990 | Carvajal et al. | 323/314 |
| 5,347,210 | 9/1994 | Nguyen | 323/315 |
| 5,349,286 | 9/1994 | Marshall et al. | 323/315 |

*Primary Examiner*—Peter S. Wong
*Assistant Examiner*—Shawn Riley
*Attorney, Agent, or Firm*—W. Daniel Swayze, Jr.; W. James Brady, III; Richard L. Donaldson

[57] ABSTRACT

A reference circuit 10 includes a current generator 12 and a voltage generator 14. The current generator 12 includes an N-channel MOS transistor MN5 and an N-channel MOS transitor MN6 which function as a beta helper. Transistors MN5 and MN6 are connected within current generator 12 and thus pull base current for bipolar transistors Q1 and Q2 from the collector current source to compensate for any low bipolar transistor gain (hfe) effects.

3 Claims, 3 Drawing Sheets

BETA HELPER FOR VOLTAGE AND CURRENT REFERENCE CIRCUITS

CROSS REFERENCE TO RELATED APPLICATIONS

This application is a Continuation, of application Ser. No. 08/267,326 filed on Jun. 28, 1994 now abandoned.

This application is related to the copending application of inventor Marshall et al. filed on Jun. 18, 1993 bearing Ser. No. 08/079/665 and coassigned to Texas Instruments Incorporated.

FIELD OF THE INVENTION

The invention is in the field of integrated circuits and more particulalry relates to voltage reference and current reference circuits.

BACKGROUND OF THE INVENTION

Many integrated circuits require a stable reference voltage and a stable current reference for operation. Examples include data acquisition systems, voltage regulators, virtual grounds, measurement devices, analog-to-digital converters and digital-to-analog converters just to name a few. U.S. Pat. No. 5,191,555 assigned to Texas Instruments Incorporated illustrates in FIG. 77 a reference voltage produced by a bandgap in a voltage regulator system for a dynamic random access memory, DRAM, application. Other bandgap reference circuits are illustrated in U.S. Pat. Nos. 5,168,209, 4,939,442, 4,906,863 and 4,362,984 all assigned to Texas Instruments Incorporated.

Prior art FIG. 1 shows a typical bandgap circuit manufactured by a power integrated circuit process where the N-channel Metal Oxide Semiconductor (NMOS) and the P-channel (PMOS) transistor devices are optimized. As a result of the MOS optimization, the bipolar devices often have poor gain characterestics (on the order of 5 to 30 for example). Most bandgap circuits rely on high gain bipolar devices, without which, as transistor beta gain (hfe) decreases, an error term may be introduced into the reference voltage or current due to the additional base current. In FIG. 1, NMOS transistor MN4 acts as a "beta helper". It decreases the dependance upon hfe to achieve accurate "mirroring" of current between bipolar transitors Q1 and Q2 by minimizing the current needed from the collector of transistor Q1 to supply base drive to transistors Q1 and Q2. The extra current is taken from the supply voltage Vcc which is connected to the collector of beta helper transistor MN4. Although transistor MN4 is effective in this regard, it does not eliminate the error term in the output voltage Vbg associated with a low hfe in transistors Q1 and Q2. When hfe is at the value of 4, the extra base current in transistor Q2 adds about 20% to the current in resistor R1, above that in the collector of transistor Q2. This leads to an offset in the reference voltage Vbg of approximately 5%. Over temperature, the gain of a bipolar device can change substantially, and might, for example be around 5 at −40° C. (typical minimum integrated circuit (IC) specification), and up at around 20 at 150° C. (typical maximum IC specification). This can lead to an undesirable variation in reference over temperature. Ideally, a voltage reference circuit would provide a constant voltage regardless of the circuit temperature or its loading conditions. The above U.S. Pat. No. 4,939,442 contains a temperature correction feature.

It is an object of this invention to compensate for low gain effects in a voltage and current reference circuit.

It is an object of the invention to provide a voltage reference circuit that provides a stable reference over temperature changes.

Other objects and advantages will be apparent to those of ordinary skill in the art having reference to the following specification and drawings.

SUMMARY OF THE INVENTION

A reference circuit includes a voltage generator and a current generator wherein the current generator has a beta helper which pulls base current from the collector current source to compensate for variations of reference voltage or current due to low gain (hfe) bipolar transistors.

BRIEF DESCRIPTION OF THE DRAWINGS

FIG. 3A is a computer SPICE simulation illustrating output voltages obtained from the uncompensated Prior Art circuit of FIG. 1 while

DETAILED DESCRIPTION OF THE PREFERRED EMBODIMENT

Figure 2:
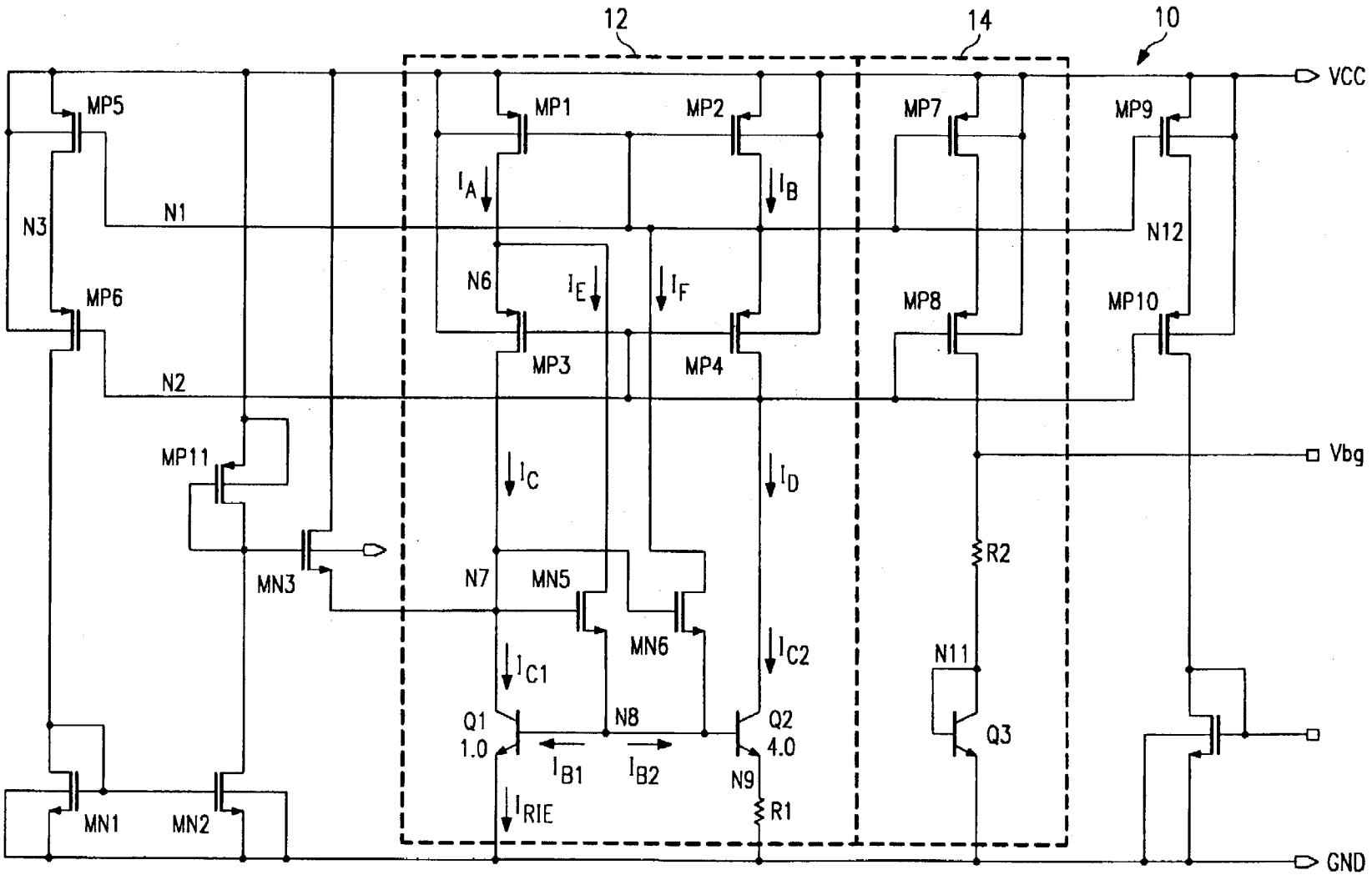
FIG. 2 is an electrical schematic illustrating the preferred embodiment of the invention.

FIG. 2 is a schematic diagram illustrating the preferred embodiment of the invention, a low gain compensated bandgap voltage reference circuit 10. Reference circuit 10 includes a current generation circuit 12 and a voltage generation circuit 14. Current generation circuit 12 includes P-channel (PMOS) transistor MP1 and a PMOS transistor MP3 connected in series between a voltage source Vcc and the collector of a bipolar transistor Q1. Similarly, a PMOS transistor MP2 and a PMOS transistor MP4 are connected in series between Vcc and the collector of a bipolar transistor Q2. The gates of transistors MP1 and MP2 are connected together at a node N1 and connected to the series connection between transistors MP2 and MP4. Similarly, the gates of transistors MP3 and MP4 are connected together at a node N2 and connected to the series connection between transistors MP4 and Q2. The bases of transistors Q1 and Q2 are connected together. The emitter of transistor Q1 is connected to ground while the emitter of transistor Q2 is connected to ground through a resistor R1. Transistors MP1 and MP2 are the same size (having the same width to length ratio) while transistors MP3 and MP4 are the same size. Transistor Q2 is about 4 times larger than transistor Q1.

In FIG. 2, current generation circuit 12 further includes an N-channel (NMOS) transistor MN5 and an NMOS transistor MN6. The gates of transistors MN5 and MN6 are connected to the series conection of transistors MN3 and Q1. The drain of transistor MN5 is connected to the series connection of transistors MP1 and MP3. The drain of transistor MN6 is connected to the bases of transistors MP1 and MP2 at node N1. The sources of transistors MN5 and MN6 are connected to the bases of transistors Q1 and Q2. Transistors MN5 and MN6 are preferably the same size, and have preferably long channel lengths to minimize lambda effects.

In FIG. 2, voltage generation circuit 14 includes a PMOS transistor MP7 and a PMOS transitor MP8 connected in series between Vcc and a resistor R2. The gate of transistor MP7 is connected to the gates of transistors MP1 and MP2 and transistor MP7 is the same size as transistors MP1 and MP2. The gate of transistor MP8 is connected to the gates of transistors MP3 and MP4 and transistor MP7 is the same size as transistors MP3 and MP4. Resistor R2 is connected to the base and collector of a bipolar transistor Q3. The emitter of transistor Q3 is connected to ground. Transistor Q3 is about the same size as transistor Q1. The gate of transistor MP7 connects voltage generation circuit 14 to current generation circuit 12 at node N1 while the gate of transistor MP8 is connected to node N2. The output bandgap reference voltage Vbg is taken at the series connection between transistor MP8 and resistor R2.

The operation of the circuit of FIG. 2 is now described. Mathematical equations illustrating how current generator 12 mirrors the required current through resistor R1 follow this discussion. Transistors MP1 and MP2 provide a current mirror. Because of the sizes of MP1 and MP2, the same amount of current is sourced to transistors Q1 and Q2. However, because transistor Q2 is larger than transistor Q1, the difference in current density provides a difference in the base-emitter voltages of transistors Q1 and Q2 and reflects the voltage existing across resistor R1.

In FIG. 2, the current supplied by transistor MP2 to transistor Q2 is mirrored to transistor MP7 of voltage generation circuit 14. Because of the sizing, transistor MP7 conducts the same amount of current as transistor MP2. Transistors MP7 and MP8 feed current to resistor R2 and transistor Q3 (configured as a diode) which provides a voltage drop across resistor R2 and a base emitter voltage drop (Vbe) across transistor Q3.

Figure 1:
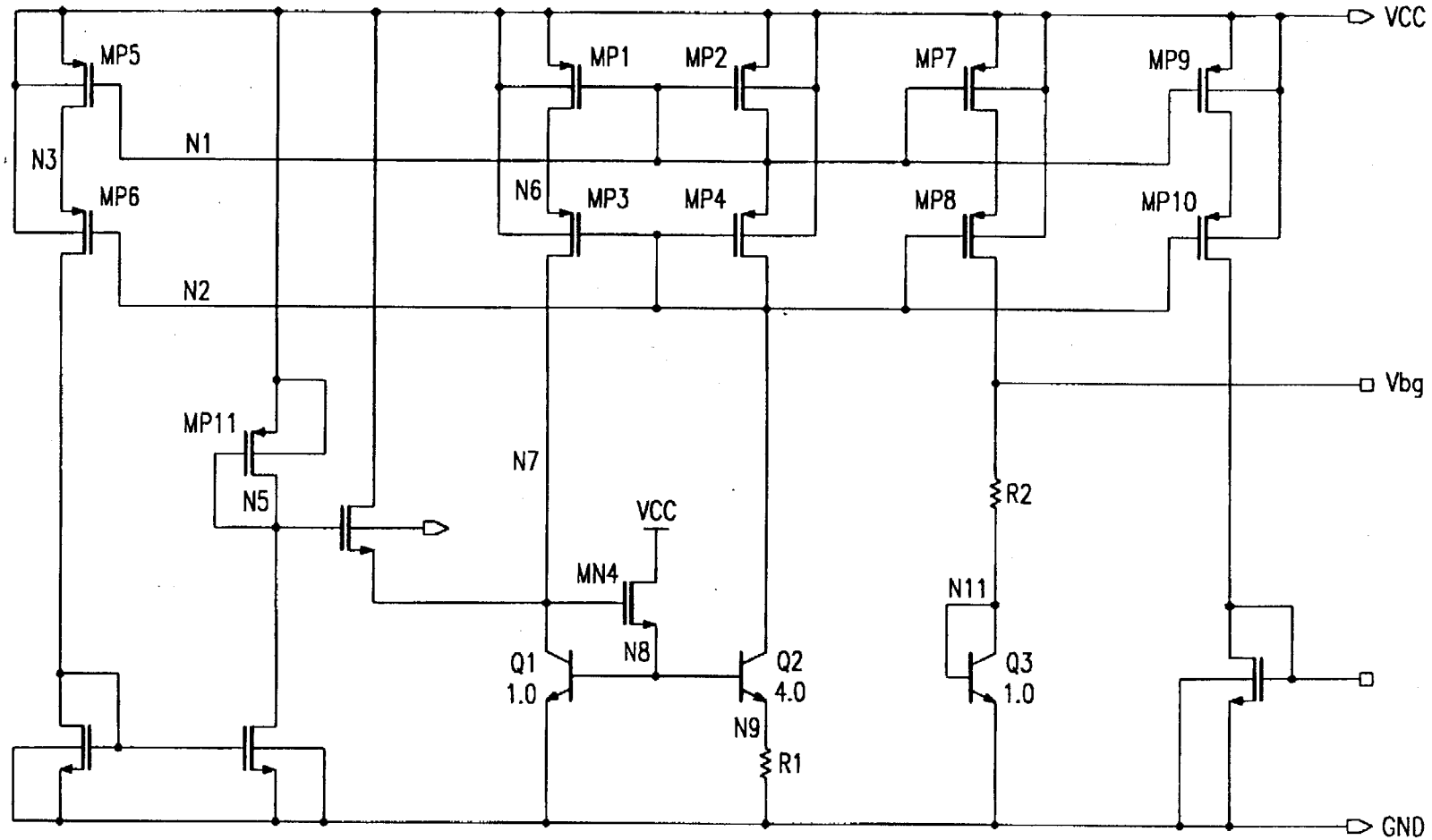
FIG. 1 (PRIOR ART)
FIG. 1 is a prior art electrical schematic illustrating a conventional bandgap circuit with no bipolar transistor gain compensation.

Bipolar transistors Q1 and Q2 of FIG. 2 have low gain as do transistors Q1 and Q2 of FIG. 1. However, the low gain effects are compensated by pulling the extra base current from the collector current source itself (as opposed to the voltage source Vcc of FIG. 1) and using the combined base and collector current to generate the bandgap current or voltage source while eliminating base current error, as is next explained. The correct base current is generated for each component (Q1 and Q2) by placing the gates of transistors MN5 and MN6 at the collector of transistor Q1 and placing the drains of transistors MN5 and MN6 at the drains of transistors MP1 and MP2. In this fashion, the current pulled through transistor MP2 is equal to the collector current of transistor Q2 plus one half the base current of transistors Q1 and Q2. To a first approximation, the base current of transistor Q1 is equal to the base current of transistor Q2; hence, it can be approximated that the current pulled through transistor MP2 is equal to the base and collector current of transistor Q2. This current is mirrored through transistor MP1. The collector current plus the base current of transistor Q1 is therefore equal to that of transistor Q2 under equilibrium conditions. Since the voltage across resistor R1 is proportional to the emitter current of transistor Q2 and not the collector current, this gives an accurate method of obtaining correct mirroring of the emitter currents to maintain accuracy of current source or voltage reference.

The following mathematical equations show how current generator 12 mirrors the required current through resistor R1. The currents used in the below equations are shown on FIG. 2.

$$V_{be} = \frac{KT}{Q} \ln\left(\frac{Ic}{Is}\right)$$

-continued $$\Delta V_{be} = \frac{KT}{Q}\left[\ln\left(\frac{Ic_1}{Is}\right) - \ln\left(\frac{Ic_2}{Is}\right)\right]$$

$$\Rightarrow \Delta V_{be}(\text{across } R1) = \frac{KT}{Q} \ln\left[\frac{Ic_1}{Ic_2}\right]$$

$$\therefore \Delta V_{be} = \frac{KT}{Q} \ln 4 \text{ at room temp.} \approx 0.026 \ln 4$$

$$\Rightarrow 36\text{mV}$$

$\Delta V_{be}$ is linearly dependent on temperature, hence for constant current, the R1 temperature coefficient needs to be proportioned to temperature to the same coefficient.

$B = Ic/Ib$ $\Delta V = V_{BQ1} - V_{BQ2}$
$I_A = I_B$
$I_C = I_A - I_E$
$I_D = I_B - I_F$
$I_F + I_E = I_{B1} + I_{B2}$
$I_{Q1E} = I_{B1} + I_C$
$I_{Q2E} = I_{B2} + I_D$
ASSUME
$I_{B1} = I_{B2}$,
THEN
$I_{Q1E} = I_{Q2E}$
$\therefore I_C = I_D$
IF
$I_C = I_D$,
AND
$I_A = I_B$
THEN
$I_E = I_F$
SINCE
$I_C = I_D$, $I_{B1} = I_{B2}$
THEN
the current generated by th $MP2/MP1$ current mirror
is $= I_{Q1E} = I_{Q2E} = IR_1 = I_D + I_F = I_C + I_E$ HENCE current generator 12 mirrors the required $IR_1$ current and the voltage across resistor R1 is proportional to the emitter current.

Figure 3A:
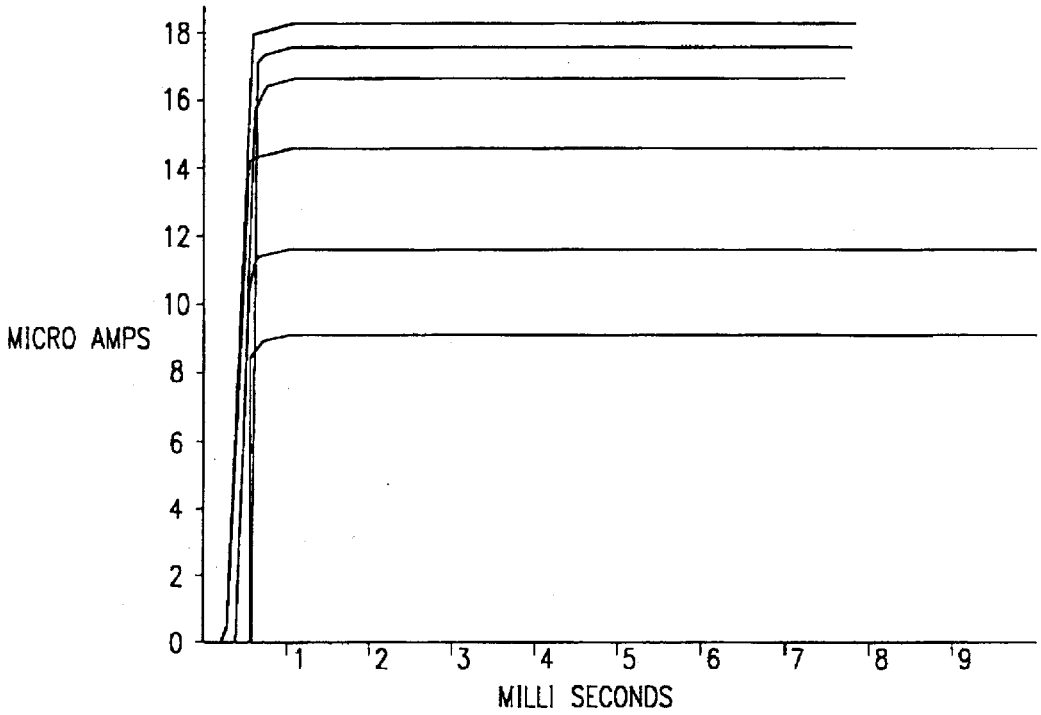
Figure 3B:
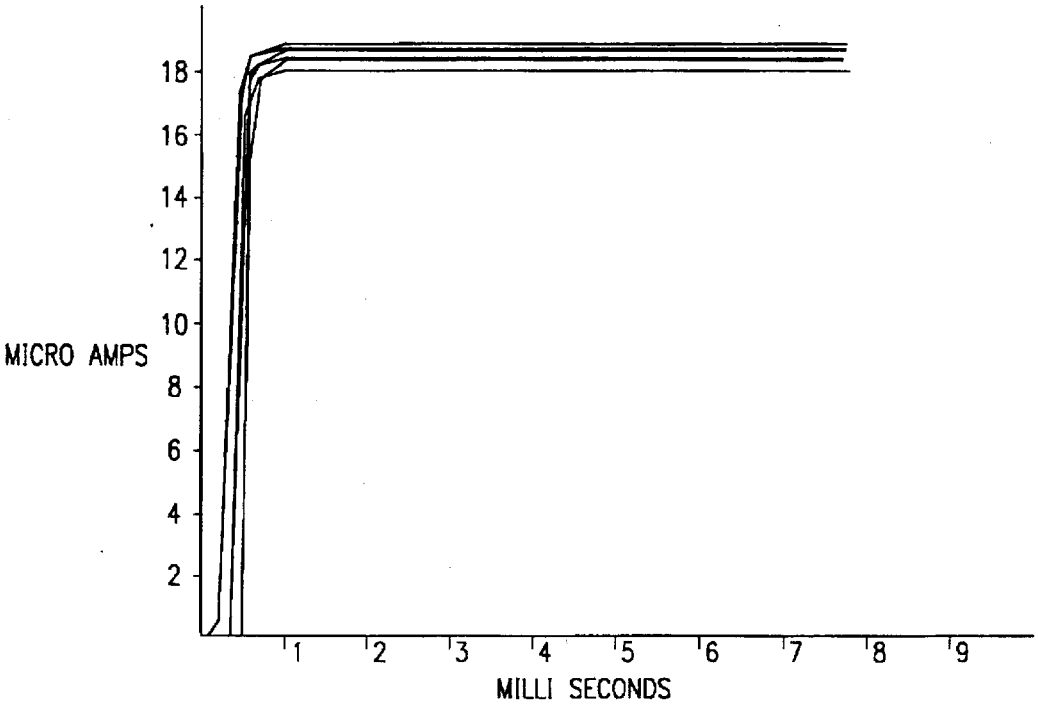
FIG. 3*b* is a computer SPICE simulation illustrating output voltages obtained from the compensated circuit of FIG. 2.

FIG. 3*a* is a SPICE simulation illustrating output voltages obtained from the uncompensated prior art circuit of FIG. 1 as beta varies while FIG. 3*b* is a SPICE simulation illustrating output voltages obtained from the compensated circuit of FIG. 2 as beta varies. The circuit of FIG. 2 having current compensation within the current generation circuitry itself provides a much more tightly grouped trace of output voltages for beta variations than the circuit of FIG. 1.

The devices in FIG. 2 to the left of current generator 12 form a conventional start up circuit for current generator 12. Before power up, no current flows through transistors MP1, MP3 and Q1. Upon power up, current flowing through MP11 pulls the gates of MN3 and MP11 high. As current flows through transistor MN3, a voltage is formed at the gate of transistor MN5 and current flows through transistor MN6. Thus, base current is provided for transistors Q1 and Q2 and current generator 12 starts up. Current also begins to flow through transistors MP5 and MP6. This current is mirrored by transistor MN2 to transistor MP11 and forces the voltage at the drain of MP11 down to zero volts turning transistor MN3 off.

While the invention has been described with reference to illustrative embodiments, this description is not intended to be construed in a limiting sense. Various other embodiments of the invention will be apparent to persons skilled in the art upon reference to this description. It is therefore contemplated that the appended claims will cover any such modifications of the embodiments as fall within the true scope and spirit of the invention.

What is claimed is:

1. A reference circuit, comprising:

a voltage generator; and a current generator connected to the voltage generator having a collector current source to generate a collector current; and a beta helper connected to the collector current source to pull base current from the collector current source, said voltage generator generating a voltage based on said base current and said collector current.

2. A bandgap reference circuit, comprising:

a current generator to generate a base current and a collector current including:

a first current leg having a first MOS P-channel transistor connected to a first bipolar transistor;

a second current leg having a second MOS P-channel transistor connected to a second bipolar transistor, the gates of the first and second MOS P-channel transistors connected together and the bases of the first and second bipolar transistors connected together;

a first beta helper having a first MOS N-channel transistor having its gate and drain connected to the connection between the first MOS P-channel transistor and the first bipolar transistor and its source connected to the bases of the first and second bipolar transistors;

a second beta helper having a second MOS N-channel transistor having its gate connected to the gate of the first MOS N-channel transistor, its drain connected to gates of the first and second MOS P-channel transistors, and its source connected to the bases of the first and second bipolar transistors; and a voltage generator circuit coupled to said current generator to generate a voltage based on said base current and said collector current.

3. The bandgap reference circuit of claim 2 wherein the voltage generator circuit includes:

a third MOS P-channel transistor having its gate connected to the gates of the first and second MOS P-channel transistors and its drain connected to a positive voltage potential;

a resistor connected to the source of the third MOS P-channel transistor; and a third bipolar transistor having its collector and base connected to the resistor and having its emitter connected to a ground voltage potential.

* * * * *